United States Patent [19]

Monson

[11] 4,127,913

[45] Dec. 5, 1978

[54] FABRIC CLEANING DEVICE

[76] Inventor: Clifford L. Monson, 49-789 Kam Hwy., Kaawa, Hi. 96730

[21] Appl. No.: 850,570

[22] Filed: Nov. 11, 1977

[51] Int. Cl.[2] ..... A47L 7/00

[52] U.S. Cl. ..... 15/321; 15/322

[58] Field of Search ..... 8/149.2, 149.3; 15/320, 15/321, 322, 345; 68/5 B, 5 C, 5 D

[56] References Cited

U.S. PATENT DOCUMENTS

| | | | |
|---|---|---|---|
| 2,029,141 | 1/1936 | Warner | 15/322 X |
| 2,270,579 | 1/1942 | Chamberlin et al. | 15/322 X |
| 3,619,849 | 11/1971 | Jones | 15/321 |
| 3,705,437 | 12/1972 | Rukavina, Jr. et al. | 15/322 X |
| 3,747,155 | 7/1973 | Koellisch | 15/321 X |
| 3,774,262 | 11/1973 | Anthony et al. | 15/322 |
| 4,014,067 | 3/1977 | Bates | 15/322 X |

*Primary Examiner*—Christopher K. Moore
*Attorney, Agent, or Firm*—James C. Wray

[57] ABSTRACT

A fabric cleaning device having a container for cleaning solution, a movable tank for waste water and a cleaning head removably attached to the tank by a vacuum hose for cleaning the fabric requires external connections to a source of electricity and a source of pressurized water. A portion of the hose is formed rigidly to provide a handle. A vacuum pump mounted on a removable tank-sealing cover for creating a vacuum within the tank has an air outlet operatively connected to a spray gun by a detachable hose. A filter connected to the pump cleans air discharged through the outlet. The spray gun is mounted on the container and has a normally closed valve for selectively discharging cleaning fluid onto the fabric. Water directed through a hose and tank mounted coupling from the source to a discharge nozzle with a normally closed valve mounted in the cleaning head selectively rinses dirt and cleaning fluid from the fabric. The vacuum pump draws the resulting mixture of cleaning fluid, water and dirt from the fabric and conveys it through the cleaning head to the tank.

The cleaning head tapers laterally to the upper end and tapers longitudinally toward the lower end. The vacuum hose is connected to the upper portion of the head adjacent the discharge nozzle. The lower portion of the head has a narrow lateral slit which provides communication between the fabric and the interior of the head for rinsing fluid and waste substances.

16 Claims, 7 Drawing Figures

FABRIC CLEANING DEVICE

BACKGROUND OF THE INVENTION

1. Field of the Invention

This invention relates generally to brushing, scrubbing and general cleaning devices and more particularly has reference to fabric cleaning devices which use vacuum suction and have nozzles with conduit connections to power and material supply units.

2. Description of the Prior Art

Pertinent United States and foreign patents are found in Class 15, subclasses 320, 321 and 322 of the official classification of patents in the United States Patent and Trademark Office.

Examples of pertinent patents are U.S. Pat. Nos. RE 25,939; 3,992,747; 2,885,713; 4,009,728; 3,840,935; 4,014,067; 3,962,745; 4,019,218; 4,023,233.

In U.S. Pat. No. 4,014,067, a cleaning head has a scrubbing brush positioned between a row of detergent jets and a row of rinsing jets. A vacuum source located forwardly of the rinsing jets draws detergent, rinse water and dirt from the carpet. Both rinse water and detergent solvent are supplied from a single source. A detergent tank connected to the detergent jet mixes detergent with the solvent prior to discharge.

In U.S. Pat. No. 2,885,713, a sponge mounted on a cleaning head is saturated selectively by water from a pressurized source or detergent from a container mounted on the head handle. The water and detergent are applied to the surface to be cleaned by the sponge and are picked up by a suction fitting connected to the head adjacent the sponge. The fluids are drawn from the head into the tank of a detached vacuum unit.

U.S. Pat. No. 4,019,218 shows a self-contained carpet cleaner connected to a fluid tank and a waste water tank. Cleaning fluid is pumped through a nozzle mounted on the cleaning wand head. Waste fluid and dirt are vacuumed up through the head into the waste tank.

In U.S. Pat. No. 4,023,233, a jet of liquid is deflected off the surface to be cleaned and is collected, along with debris, in a duct positioned ahead of the area of impingement of the jet.

U.S. Pat. No. 3,962,745 discloses a cleaning head in which vacuum is supplied to an annular opening surrounding a fluid discharge nozzle.

In U.S. Pat. No. 3,840,935 a cleaning head is provided with a specially shaped partition between a spray compartment and vacuum compartment to improve cleaning action and water pick up.

U.S. Pat. No. 3,992,747 discloses a cleaning head having a scrubbing block and squeegee blades.

In U.S. Pat. No. RE 25,939, dirty detergent is vacuumed from the floor and conveyed to a collapsible waste receptacle mounted within the cleaning fluid container. During operation of the scrubber, cleaning fluid is dispensed onto the floor. As the level in the container goes down, the space vacated in the container is occupied by the expanding waste receptacle.

U.S. Pat. No. 4,009,728 shows a water valve mounted on the vacuum wand of a steam cleaner.

Many problems remain in prior art cleaning devices. Many of the prior art devices only provide discharge nozzles for cleaning fluid. No separate discharge nozzles for cleaning fluid and rinsing fluid are provided. Those prior art patents which dispense both cleaning fluid and rinsing fluid have the fluid discharge nozzles permanently attached to the underside of the cleaning head. The cleaning fluid and rinsing fluid nozzles are supplied from a single source. In addition, nozzle operating pressure is provided solely by the fluid source.

SUMMARY OF THE INVENTION

The present invention overcomes many problems which exist in prior art devices.

The present invention has three main modes of operation. In the simplest mode, dirt is removed from fabrics by normal vacuuming. In another mode of operation, jets of water sprayed into the fabric loosen the dirt from the fabric. The water and dirt are then immediately vacuumed. In the third mode of operation, cleaning fluid is sprayed from a hand-held container into the fabric. Rinsing water is applied to the fabric to dislodge dirt and cleaning fluid. A mixture of cleaning fluid, rinsing water and dirt are then immediately vacuumed. Each mode may be used separately or combined sequentially with other modes to fully clean the fabric.

The device is compact and is designed for simple and inexpensive manufacture. Unnecessary components found in many of the prior art devices have been eliminated. The device has no cleaning solution holding tank and no cleaning solution pressure pump. Instead, cleaning solution is placed in a hand-held container fitted with an air-operated spray gun. The spray gun is operatively connected to a pressurized air outlet on the vacuum pump. In addition, the device has no rinsing fluid holding tank and no rinsing fluid pressure pump. Instead, a coupling is provided to connect the rinsing fluid nozzle with a standard faucet or pressurized outlet.

In preferred form, the present invention provides a container for cleaning solution, a movable waste tank and a cleaning head. The cleaning head is removably connected to the tank by a vacuum conduit. A portion of the conduit is formed rigidly to provide a handle.

A vacuum pump assembly is mounted on a removable tank-sealing cover for creating a vacuum within the tank. The pump requires connection to an external source of electricity. A pressurized air outlet on the pump is operatively connected to a spray gun by a detachable hose. A filter is connected to the pump to clean the air discharged through the outlet.

The spray gun is mounted on the cleaning fluid container for discharging the fluid from the container onto the fabric. The gun has a normally closed valve which permits selective operation of the gun. The spray gun has a conduit whose interior is in communication with the interior of the cleaning fluid container. A tube having one end disposed in the cleaning fluid container and a remote end concentrically disposed within the conduit is presented toward the outlet end of the conduit. The outlet end is provided with a spray nozzle and the inlet end is connected to the air outlet on the vacuum pump.

Water is directed through a hose and a tank mounted coupling from the pressurized source to a rinse water discharge nozzle mounted in the cleaning head. The nozzle is provided with a normally closed valve for selective operation. The vacuum pump draws a mixture of cleaning fluid, rinse water and dirt from the fabric and conveys it through the cleaning head and vacuum hose to the waste tank.

The cleaning head tapers laterally toward the upper end and tapers longitudinally toward the lower end. The lateral dimensions of the lower end are substantially greater than the longitudinal dimensions and the longitudinal dimensions of the upper end are greater than the lateral dimensions. The vacuum hose is connected to the upper portion of the head adjacent the discharge nozzle. The lower portion of the head has a narrow, laterally extending slit which provides communication between the fabric and the interior of the head.

Objects of the invention are, therefore, to provide an improved fabric cleaning device, to provide a fabric cleaning device which is simple and inexpensive to manufacture, to provide a fabric cleaning device which is compact, and to provide a fabric cleaning device having three main modes of operation.

Another object of the invention is to provide a fabric cleaning device having a tank, a vacuum pump assembly operatively connected to the tank for creating a vacuum within the tank, means connected to the vacuum pump assembly for communicating electrical power from a source of electrical power to the vacuum pump assembly, cleaning head means having lower mouth means adapted to be positioned in contact with a surface to be cleaned for drawing waste substances from the surface, vacuum conduit means connected to the cleaning head means and tank for communicating waste substances from the lower mouth means to the interior of the tank under vacuum pressure, discharge means connected to the cleaning head means for dispensing rinsing fluid onto the surface adjacent the lower mouth means, fluid conduit means connected to the discharge means for communicating rinsing fluid from a pressurized source of rinsing fluid to the discharge means, a cleaning fluid container for storing cleaning fluid, spray means connected to the cleaning fluid container for directing pressurized air toward the container to urge cleaning fluid from the container and spray the fluid urged from the container onto the surface, air outlet means connected to the vacuum pump assembly for discharging pressurized air from the vacuum pump assembly, and air conduit means connected to the air outlet means and spray means for communicating pressurized air from the air outlet means to the spray means.

These and other and further objects and features of the invention are apparent in the disclosure which includes the above and below specification and claims and drawings.

DETAILED DESCRIPTION OF THE DRAWINGS

Figure 1:
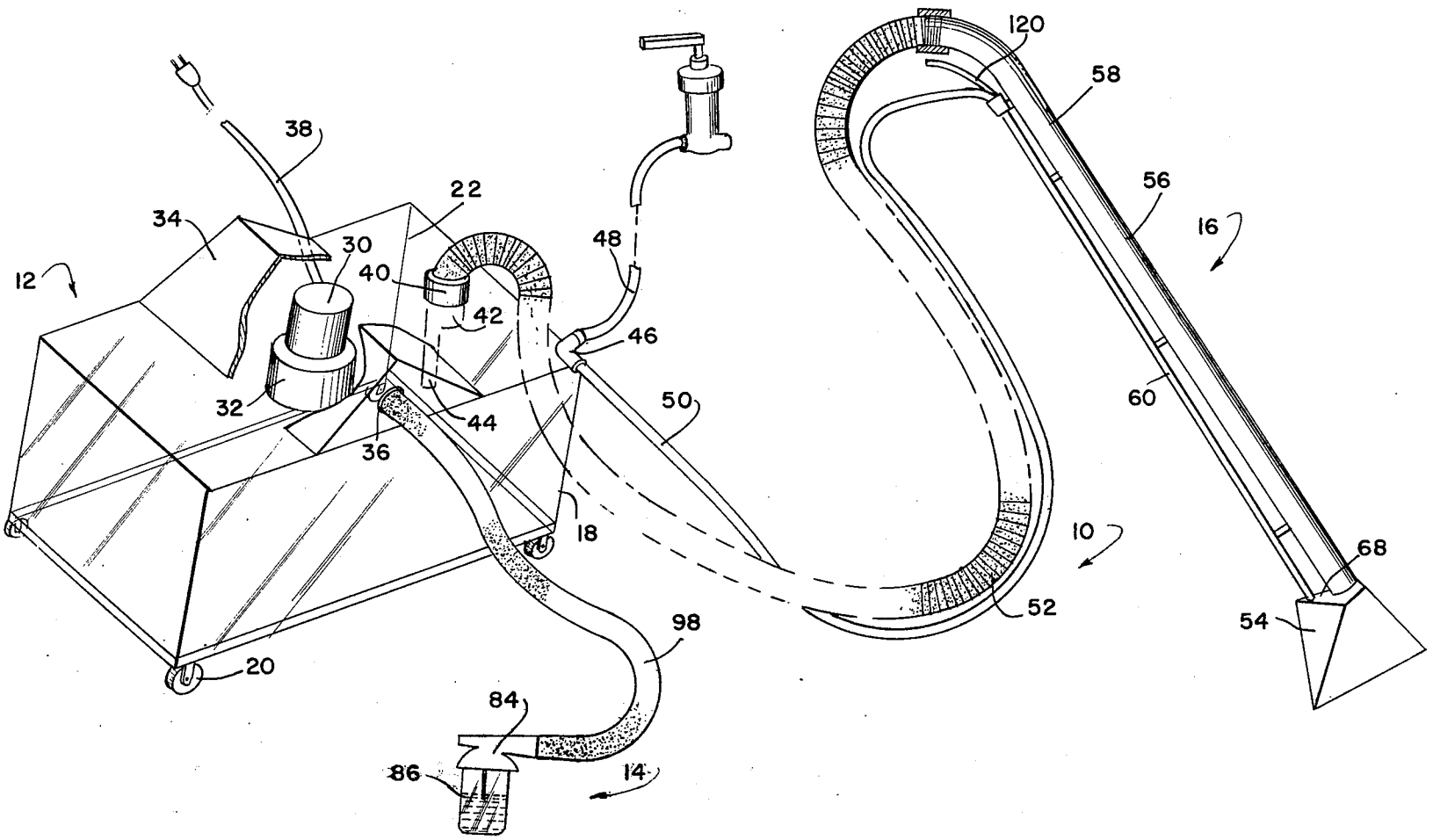
FIG. 1 is a perspective view of the fabric cleaning device of the present invention.

Referring to FIG. 1, the fabric cleaning device of the present invention is generally indicated by the numeral 10. The device 10 has a tank unit 12, a spray unit 14 and a wand 16.

The tank unit 12 has an open top tank 18 mounted on wheels 20 to facilitate movement of the tank unit 12 across the surface to be cleaned.

A cover 22 is designed to extend across the open top of the tank 18. The opening 24 in the top of the tank 18 should be sufficiently large to permit removal of waste substance from the interior of the tank 18 and to permit easy cleaning of the tank 18. In the preferred embodiment, the opening 24 in the top of the tank 18 comprises the entire top surface of the tank 18. The cover 22 is provided with a beveled circumferential edge 26 which engages a mating beveled surface 28 on the upper circumferential edge of the tank 18. When the cover 22 is properly positioned across the opening 24 in the top of the tank 18 and a vacuum is drawn in the tank 18, the weight of the cover 22 and the inwardly pulling force of the vacuum within the tank 18 urge the beveled edges 26 and 28 into sealing engagement. The cover 22 and tank 18 thereby provide a sealed waste tank. Preferably, the cover 22 is formed of the same material as the tank 18.

A vacuum pump 30 is mounted on the top of the cover 22. The pump 30 is configured to create a vacuum within the tank 18. A dust filter 32 is connected to the pump 30 and extends through the cover 22 into the interior of the tank 18. As air is drawn from the tank 18 by the pump 30 the filter 32 removes debris from the air. A pump housing 34 is mounted on the cover 22 and encloses the pump 30. Air drawn from the interior of the tank 18 by the pump 30 is exhausted by the pump 30 into the interior of the housing 34. An air outlet 36 is provided in the side of the housing 34 to allow the exhausted air to be discharged from the housing 34. An electric power supply cord 38 is connected to the pump 30 and extends through the housing 34 to a source of electrical power for operating the pump 30.

A vacuum intake port 40 is provided in the cover 22 externally of the pump housing 34. The lower end 42 of the intake port 40 extends a short distance inside the tank 18. A baffle 44 is connected to the cover 22 adjacent the lower end 42 of the intake port 40. The baffle 44 extends a substantial distance inside the tank 18 and is positioned between the lower end 42 of the intake port 40 and the dust filter 42. In this position, the baffle 44 prevents waste material entering the tank 18 through the intake port from being diverted into the vacuum pump 30 and dust filter 32.

In the preferred embodiment, a hose coupling 46 is mounted in a corner of the cover 22. Both ends of the hose coupling 46 are provided with appropriate connecting means, such as screw threads, designed to engage mating hose coupling means on the ends of fluid hoses. A hose 48 is connected to one end of the coupling 46 and to a supply of pressurized water such as an ordinary home faucet.

A second hose 50 is connected to the hose coupling 46. The coupling 46 permits fluid communication between the hoses 48 and 50. The hose 50 is clamped to a flexible vacuum hose 52 which is connected to the vacuum hose intake port 40. Preferably, the end of the vacuum hose 52 is configured to provide an interference fit around the outer surface of the intake port portion 40 extending above the cover 22. The hose 50 and vacuum hose 52 extend in parallel to the wand 16.

The wand 16 has a cleaning head 54 connected to the lower end of a rigid, hollow stem 56. The upper portion 58 of the stem 56 is curved rearwardly to provide a handle. A pressure hose 60 is clamped to the stem 56 and extends from the cleaning head 54 to the upper portion 58 of the stem 56. The hose 50 from the hose coupling 46 is removably connected to the upper end of the pressure hose 60 by any appropriate hose coupling. The end of the vacuum hose 52 is removably connected to the end of the upper portion 58 of the stem 56. Preferably, the connection between the vacuum hose 52 and the stem 56 is of a type similar to the connection between the vacuum hose 52 and the vacuum intake port 40.

The cleaning head 54 is shown in detail in FIGS. *6a* and *6b*. The stem 56 terminates in an opening 62 in the head 54. The opening 62 provides communication between the interior of the stem 56 and the interior of the head 54. The end of the pressure hose 60 is connected to a discharge nozzle 64 mounted on the head 54 adjacent the opening 62. A baffle 66 is connected to the head 54 and positioned between the discharge nozzle 64 and the opening 62 to prevent water discharged through the nozzle 64 from being diverted through the opening 62.

The head 54 is specially shaped to provide an efficient and effective cleaning operation. The stem 56 and pressure hose 60 are connected to a rectangular top portion 68 of the head 54. The portion 68 has longitudinal dimensions which are greater than the lateral dimensions. The opening 62 and the nozzle 64 are longitudinally aligned on the top portion 68 with the nozzle 64 positioned rearwardly of the opening 62. The head 54 extends downwardly from the top portion 68 tapering longitudinally and widening laterally. The head 54 terminates downwardly in a narrow laterally extending slit 70. The slit 70 permits communication between the interior of the head 54 and the fabric.

Figure 4:
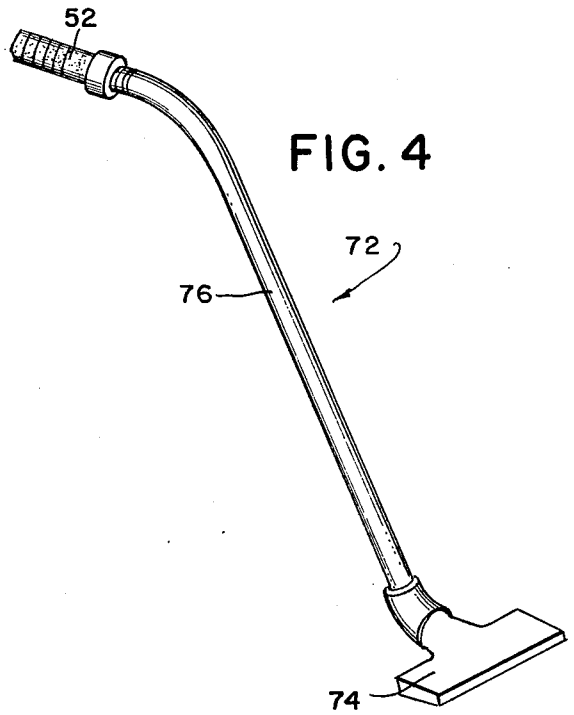
FIG. 4 is a perspective view of one cleaning head and wand used with the present invention.
Figure 2:
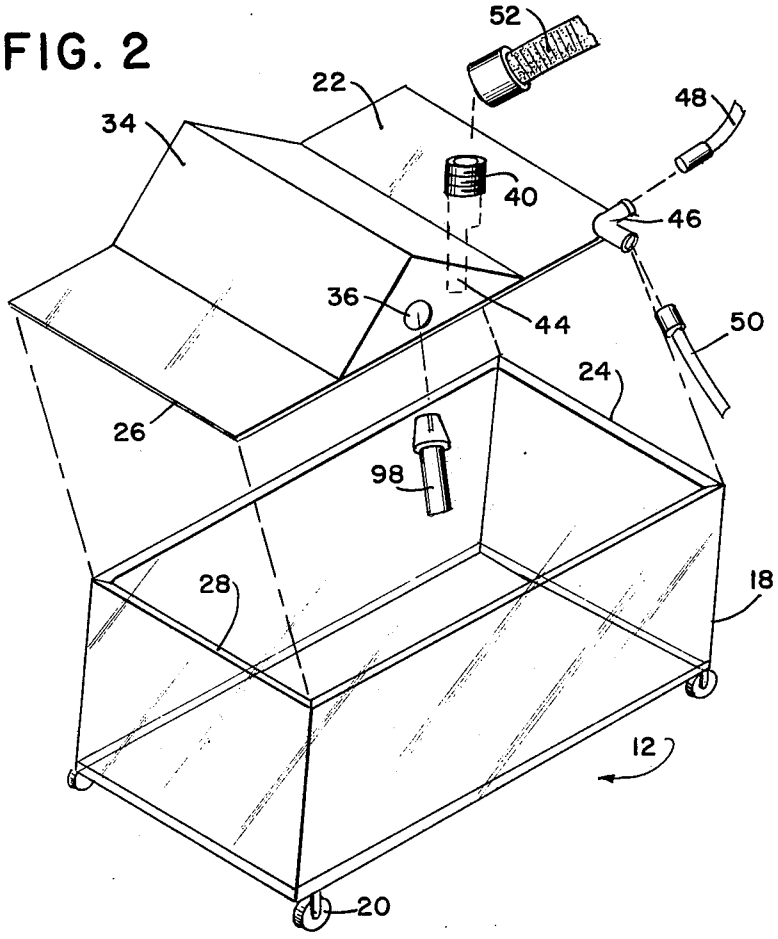
FIG. 2 is an exploded perspective view of the tank cover disconnected from the tank and the connecting hoses.
Figure 3:
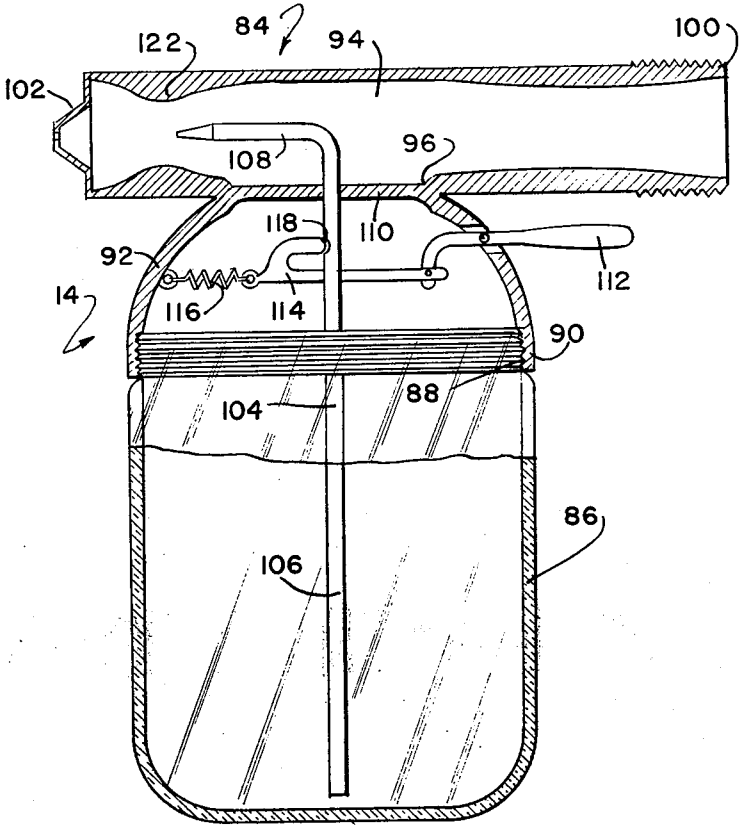
FIG. 3 is a cross-sectional detail view of the cleaning fluid container and spray gun.
Figure 5:
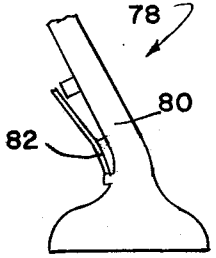
FIG. 5 is a perspective view of another cleaning head and wand used with the present invention.
Figure 6A:
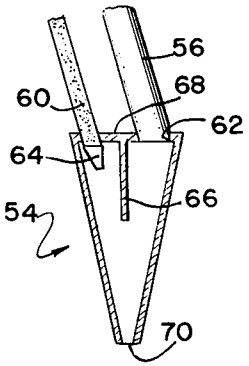
FIG. 6*a* is a side elevation, in section, of the preferred cleaning head shown in FIG. 1.
Figure 6B:
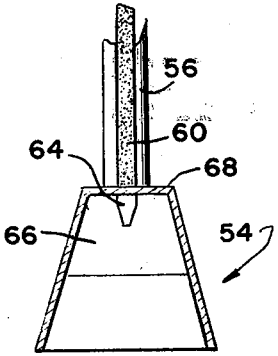
FIG. 6*b* is a rear elevation, in section, of the preferred cleaning head shown in FIG. 1.

Alternative embodiments of wands used in the present invention are shown in FIGS. 4 and 5. The wand 72 in FIG. 4 is a standard vacuuming wand having a vacuum head 74 connected to the end of a hollow stem 76. The wand 78 shown in FIG. 5 is similar to the wand 16 shown in FIG. 1. Most significantly, the wand 78 differs from the wand 16 by providing a substantially shortened stem 80 and pressure hose 82. The long stemmed wand 16 is preferably used for cleaning carpets and the short stemmed wand 78 is preferably used for cleaning upholstry, drapes, and other fabrics.

The spray unit 14 has a spray gun 84 sealably connected to a cleaning fluid container 86. Preferably, the upper circumferential portion of the container 86 is provided with external threads 88 which matingly engage corresponding internal threads 90 on the base portion 92 of the spray gun 84 to provide a removable connection between the spray gun 84 and the container 86.

The upper portion of the spray gun 84 forms a conduit 94 which communicates with the interior of the container 86 through an opening 96 in the conduit 94. The inlet end of the conduit 94 is provided with appropriate means for connection to an air hose 98 extending from the air outlet 36 in the pump housing 34. Preferably the means comprise external threads 100 on the conduit 94 which are configured to engage mating threads on the end of the air hose 98. The outlet end of the conduit 94 is provided with a spray nozzle 102. Preferably, the connection between the air outlet 36 and the air hose 98 permits removal of the hose 98 from the outlet 36.

A narrow tube 104 has a lower end 106 disposed in the cleaning fluid container 86 adjacent the bottom thereof and has an upper end 108 concentrically disposed within the conduit 94. The upper end 108 of the tube 104 is presented toward the spray nozzle 102. The tube 104 is supported in the gun 84 by a bracket 110.

The spray gun 84 is provided with a normally closed valve comprising a lever 112, a plug 114 and a spring 116. The lever 112 is pivotally mounted in an opening in the base portion 92 of the spray gun 84. The inward end of the lever 112 is pivotally connected to the end of the plug 114. The plug 114 is configured to selectively extend across an opening 118 in the tube 104 to sealably close the opening. The plug 114 is biased away from the opening 118 by a spring 116. Movement of the outer end of the lever 112 toward the conduit 94 pulls the plug 114 into sealing engagement with the opening 118, thereby permitting discharge of fluid from the spray gun 84 in a manner more particularly described later.

The various modes of operation of the present invention can now be fully understood.

In the simplest mode, the vacuuming wand 72 is connected to the tank unit 12 by the vacuum hose 52. As in any normal vacuuming process, the underside of the vacuum head 74 is placed in contact with the surface to be cleaned. The vacuum pump 30 is operated to create a vacuum within the tank 18 which draws dirt from the surface through the vacuum wand 72, vacuum wand 52 and vacuum intake port 40 into the tank 18.

In another mode of operation, the wand 16 is connected to the tank unit 12 by the fluid hose 50 and vacuum hose 52. The hose coupling 46 is connected to a source of pressurized water such as a household faucet. As in the first mode of operation, the underside of the cleaning head 54 is placed in contact with the surface to be cleaned. By operating a normally closed valve 120 connected to the pressure hose 60, the operator can selectively discharge jets of water from the nozzle 64 in the cleaning head 54 into the surface. By then moving the head 54 back and forth across the surface the water and loosened soil are immediately drawn up through the slit 70 into the cleaning head 54 and conveyed from the cleaning head 54 to the tank 18 by the stem 56 and vacuum hose 52.

In the third and preferred mode of operation, the tank unit 12 and wand 16 remain connected as described in the second mode of operation. In addition, the spray unit 14 is connected to the air outlet 36 by the air hose 98. The cleaning fluid container 86 is filled with any desired cleaning fluid or liquid detergent. As the vacuum pump 30 is operated to create a vacuum within the tank 18, pressurized exhaust from the pump 30 is communicated to the spray gun 84 by the air hose 98. The stream of pressurized air flows through the spray gun conduit 94 and is accelerated in the venturi portion 122 of the conduit 94. This causes the air outside the tube 104 to be at a pressure lower than the air inside the tube 104 which thereby forces the cleaning fluid up the tube 104. The fluid is picked up by the pressurized air at the upper end 108 of the tube 104 and is discharged through the spray nozzle 102. When the operator releases the valve lever 112, the plug 114 disengages from the opening 118 in the tube 104 resulting in an air flow through the tube 104 which prevents movement of the cleaning fluid up the tube.

By operating the valve lever 112, cleaning fluid is selectively discharged into the surface to be cleaned. The fluid is then allowed to settle into the fabric for an appropriate length of time. The exact length of time differs with the cleaning fluid selected for use, but generally is a length of time which allows the cleaning fluid to effectively dislodge dirt, soil and stains from the fabric without damaging the fabric. The cleaning fluid and dirt are then rinsed from the fabric and vacuumed, along with the rinsing water, into the waste tank 18 by using the wand 16 in the manner described in the second mode of operation. Depending upon the needs of the operator and the type of cleaning fluid used, cleaning fluid can be applied to small portions of the fabric which are then immediately rinsed and vacuumed or cleaning fluid can be applied to substantially the entire surface of the fabric followed by rinsing and vacuuming of the entire surface.

For the most effective cleaning operation, the fabric is first vacuumed by using the present invention in the first mode of operation. After vacuuming, the fabric is cleaned by using the invention in the third mode of operation. Although the second and third modes of operation have been described with reference to the long-stemmed wand 16 which is preferred for use in cleaning carpets, the same modes are equally effective in cleaning upholstered furniture, drapes and other fabrics if the long-stemmed wand 16 is replaced by the short-stemmed wand 80 shown in FIG. 5.

While the invention has been described with reference to a specific embodiment, the exact nature and scope of the invention is defined in the following claims.

What is claimed is:

1. Cleaning apparatus comprising a tank, a vacuum pump assembly operatively connected to the tank for creating a vacuum within the tank, means connected to the vacuum pump assembly for communicating electrical power from a source of electrical power to the vacuum pump assembly, cleaning head means having lower mouth means adapted to be positioned in contact with a surface to be cleaned for drawing waste substances from the surface, vacuum conduit means connected to the cleaning head means and tank for communicating waste substances from the lower mouth means to the interior of the tank under vacuum pressure, discharge means connected to the cleaning head means for dispensing rinsing fluid onto the surface adjacent the lower mouth means, fluid conduit means connected to the discharge means for communicating rinsing fluid from a pressurized source of rinsing fluid to the discharge means, a cleaning fluid container for storing cleaning fluid, spray means connected to the cleaning fluid container for directing pressurized air toward the container to urge cleaning fluid from the container and spray the fluid urged from the container onto the surface, air outlet means connected to the vacuum pump assembly for discharging pressurized air from the vacuum pump assembly, and air conduit means connected to the air outlet means and spray means for communicating pressurized air from the air outlet means to the spray means.

2. The apparatus of claim 1 wherein the tank has an upper opening sufficiently large to remove waste substances from the interior of the tank, and further comprising, cover means removably extending across the opening and configured to sealably cover the opening.

3. The apparatus of claim 2 wherein the vacuum pump assembly is mounted on the cover means.

4. The apparatus of claim 1 further comprising filter means connected to the vacuum pump assembly for removing waste substance from the pressurized air discharged from the vacuum pump assembly by the air outlet means.

5. The apparatus of claim 1 wherein the vacuum conduit means is removably connected to the cleaning head means and tank, the fluid conduit means is removably connected to the discharge means, and the air conduit means is removably connected to the air outlet means and spray means.

6. The apparatus of claim 1 further comprising support means connected to the tank for facilitating movement of the tank across the surface.

7. The apparatus of claim 1 wherein the fluid conduit means comprise a first fluid conduit connected to the discharge means, a conduit coupling mounted on the tank and connected to the first fluid conduit remote from the discharge means, a second fluid conduit connected to the conduit coupling remote from the first fluid conduit for communicating fluid from the source to the coupling.

8. The apparatus of claim 1 further comprising first normally closed valve means connected to the discharge means for regulating the flow of fluid from the discharge means, and second normally closed valve means connected to the spray means for regulating the flow of fluid from the spray means.

9. The apparatus of claim 1 wherein the lower mouth means has an opening which permits communication between the surface and the interior of the lower mouth means, the cleaning head means has an upper portion whose interior is disposed in communication with the interior of the lower mouth means, and the discharge means is mounted on the upper portion and configured to dispense the rinsing fluid into the interior of the upper portion, the fluid directed from the upper portion to the lower mouth means and onto the surface through the opening in the lower mouth means.

10. The apparatus of claim 9 wherein the vacuum conduit means is connected to the upper portion of the cleaning head means adjacent the discharge means, the waste substances directed to the interior of the lower mouth means through the opening and directed from the interior of the lower mouth means to the vacuum conduit means through the interior of the upper portion.

11. The apparatus of claim 10 wherein the lateral dimensions of the lower mouth means are substantially greater than the longitudinal dimensions of the lower mouth means, the longitudinal dimensions of the upper portion are greater than the lateral dimensions of the upper portion, the lower mouth means provided with a laterally extending slit forming said opening.

12. The apparatus of claim 1 wherein the spray means comprise, a conduit whose interior is disposed in communication with the interior of the cleaning fluid container and having an intake end and an outlet end, means connected to the conduit and the cleaning fluid container for sealably attaching the conduit to the cleaning fluid container, a tube having one end disposed in the cleaning fluid container adjacent the bottom thereof and having a remote end concentrically disposed within the conduit presented toward the outlet end, air conduit coupling means connected to the intake end for sealably connecting the intake end to the air conduit means, and spray nozzle means connected to the outlet end for discharging fluid from the spray means as a spray.

13. The apparatus of claim 1 wherein the lower mouth means is adapted to be positioned in contact with the surface for drawing a mixture of cleaning fluid, rinsing fluid and dirt from the surface.

14. The apparatus of claim 1 wherein the vacuum conduit means comprise, a first conduit portion connected to the cleaning head means, a second conduit portion connected to the end of the first conduit portion remote from the cleaning head means and to the tank, the first conduit portion formed of a rigid material and having the end remote from the cleaning head means configured to provide a handle, the second conduit portion formed of a flexible material.

15. The apparatus of claim 1 further comprising a baffle connected to the tank and extending into the interior of the tank between the vacuum pump assembly and the vacuum conduit means.

16. The apparatus of claim 1 further comprising a baffle connected to the cleaning head means and extending into the interior of the cleaning head means between the vacuum conduit means and the discharge means.

* * * * *